US007144138B2

(12) United States Patent
Dupuis et al.

(10) Patent No.: US 7,144,138 B2
(45) Date of Patent: Dec. 5, 2006

(54) HIGH LIGHT DENSITY FLUORESCENT LUMINAIRE

(75) Inventors: Normand Dupuis, Quebec (CA); Joseph Aliberti, Quebec (CA)

(73) Assignee: Peerless Electric Company Ltd. (CA)

( * ) Notice: Subject to any disclaimer, the term of this patent is extended or adjusted under 35 U.S.C. 154(b) by 0 days.

(21) Appl. No.: 10/783,384

(22) Filed: Feb. 20, 2004

(65) Prior Publication Data

US 2004/0246728 A1 Dec. 9, 2004

(30) Foreign Application Priority Data

Feb. 21, 2003 (CA) ..... 2419484

(51) Int. Cl.
*F21S 13/10* (2006.01)
*F21V 15/01* (2006.01)

(52) U.S. Cl. ..... 362/367; 362/363; 362/812; 40/574

(58) Field of Classification Search ..... 362/367, 362/363, 431, 812; 40/564, 577, 574
See application file for complete search history.

(56) References Cited

U.S. PATENT DOCUMENTS 5,537,304 A * 7/1996 Klaus ..... 362/367
6,840,658 B1 * 1/2005 Anderson et al. ..... 362/367
6,869,203 B1 * 3/2005 Martineau ..... 362/246

* cited by examiner

*Primary Examiner*—Alan Cariaso
*Assistant Examiner*—Anabel Ton
(74) *Attorney, Agent, or Firm*—Kaplan Gilman Gibson & Dernier LLP

(57) ABSTRACT

An extra high light density fluorescent luminaire having an upper portion and a lower portion one of, said portions having at least one advertising sign thereon.

1 Claim, 15 Drawing Sheets

HIGH LIGHT DENSITY FLUORESCENT LUMINAIRE

RELATED APPLICATION

This application claims priority to Canadian Patent Application No. 2,419,484, filed on Feb. 21, 2003.

FIELD OF THE INVENTION

This invention relates to fluorescent lighting fixtures. In particular, this invention relates to extra high light density fluorescent luminaires.

BACKGROUND OF THE INVENTION

It is common practice to use Lighting fixtures employing fluorescent lamps, to provide the main lighting of large and small spaces, replacing or complementing incandescent lights in the majority of commercial and industrial applications.

Fluorescent lighting fixtures are commonly made to direct the lamp light downward towards the floor or upwards towards the ceiling or in a combination of both to meet the particular user needs in offices, stores, mass merchandizing areas or factories, wherever fluorescent lights are used It is also common to use reflectors behind the lamps and diffusers in front of the lamps to control where the emitted light is being directed and to place the electrical components in special sides of the fixtures.

It is common also to install fluorescent luminaries in long linear lines due to the limited number of lamps, usually 4 to 6 that the lighting fixture can accommodate side by side in the standard 2 foot wide fixture size used by the industry.

The disadvantages of the present practice are that a larger number of fixtures are required per installation due to the fewer lamps each fixture can accommodate. The limited possibilities of installing the fixtures over the space to be lighted except in end to end in long rows and the limitation of the fluorescent fixture applications to low and medium height ceilings of about 15 to 20 ft due to the small number of lamps per fixture, and the time and cost of individually mounting or changing the electrical components inside the fixture.

It is also common practice at present, to use two types of fluorescent fixtures in the same commercial space, one to provide the general space lighting and another lighting fixture to display commercial messages or directional signs on the sides of that fixture.

The disadvantage of these special illuminated display fixtures is that they are expensive, require special independent installation and they add to the cost of the lighting installation and are only visible in the direct areas where they are installed.

Examples of the prior art are U.S. Pat. No. 6,024,468 (issued Feb. 15, 2000, Kassay et al) and U.S. Pat. No. 6,428,183 B1 (Aug. 6, 2002, McAlpin).

Improvements are continuously sought to improve optical efficiency and to reduce cost of luminaries.

SUMMARY OF THE INVENTION

According to the present invention there is provided a luminaire comprising a lower portion, an upper portion, said lower portion having at least one lamp to illuminate the space therebeneath, said upper portion having at least one lamp to illuminate each advertising sign thereon, one or more side panels on one of said portions for supporting at least one advertising sign and said upper portion having at least one lamp to, in use, illuminate each advertising sign thereon.

As used herein, the term "dome-shaped" means having a circular, elliptical, rectangular or square-shaped base and having one or more sides upstanding therefrom and curving towards a peak.

DESCRIPTION OF THE DRAWINGS

Embodiments of the invention will now be described by way of example with reference to the accompanying drawings in which:

FIG. 3 shows the luminaire box or compartment;

FIG. 4 illustrates the back side or top of the luminaire box or compartment showing the corner slots;

FIG. 5 illustrates the luminaire box or compartment showing the perimeter rails attached and support tubes;

FIG. 6 illustrates the luminaire box or compartment showing the perimeter rails and support tubes attached and the wiring conduit;

FIG. 7 illustrates the top wiring/suspension box and outlet box assembled together;

FIG. 8 shows the top wiring/suspension box;

FIG. 9 illustrates the wiring connection box;

FIG. 10 illustrates the assembly attached to the support tubes;

FIG. 11 illustrates the opaque shielding panels placed in rail and bent to touch the support tubes;

FIG. 12 illustrates the shielding retainer item attached to retain shieldings;

FIG. 13 illustrates a lamp item used to light the dome;

FIG. 14 illustrates removable advertising panels to be inserted on top of the permanent shielding shown on the side;

FIG. 15 illustrates removable sign panel being inserted on top of the permanent panel;

FIG. 16 shows the translucent advertising panel fully inserted;

FIG. 17 shows the finished top dome with all the items installed; and from a different angle to that of FIG. 1;

FIG. 18 illustrates the bottom of the luminaire box or compartment;

FIG. 19 illustrates the curved socket support brackets;

FIG. 20 illustrates the socket support bracket shown with 10 socket positions filled with sockets;

FIG. 21 illustrates reflectors attached to the socket support;

FIG. 22 illustrates another view of the socket support item with reflectors installed;

FIG. 23 illustrates the backside of socket support item and reflector assembly with brackets item added;

FIG. 24 illustrates the modular wiring arrangement showing socket support brackets, reflector, ballast plus sockets and all wiring on one assembly for quick insertion in box;

FIG. 25 illustrates the complete assembly of socket support modular assembly in the luminaire housing;

FIG. 26 illustrates the complete lower compartment of the housing showing 10 lamps installed;

FIG. 27 illustrates an alternate socket installation with ballasts installed in the box;

FIG. 28 illustrates the complete lower compartment with reflectors and socket supports, less lamps; and FIG. 29 illustrates the complete lower compartment with lamps.

DETAILED DESCRIPTION

Figure 1:
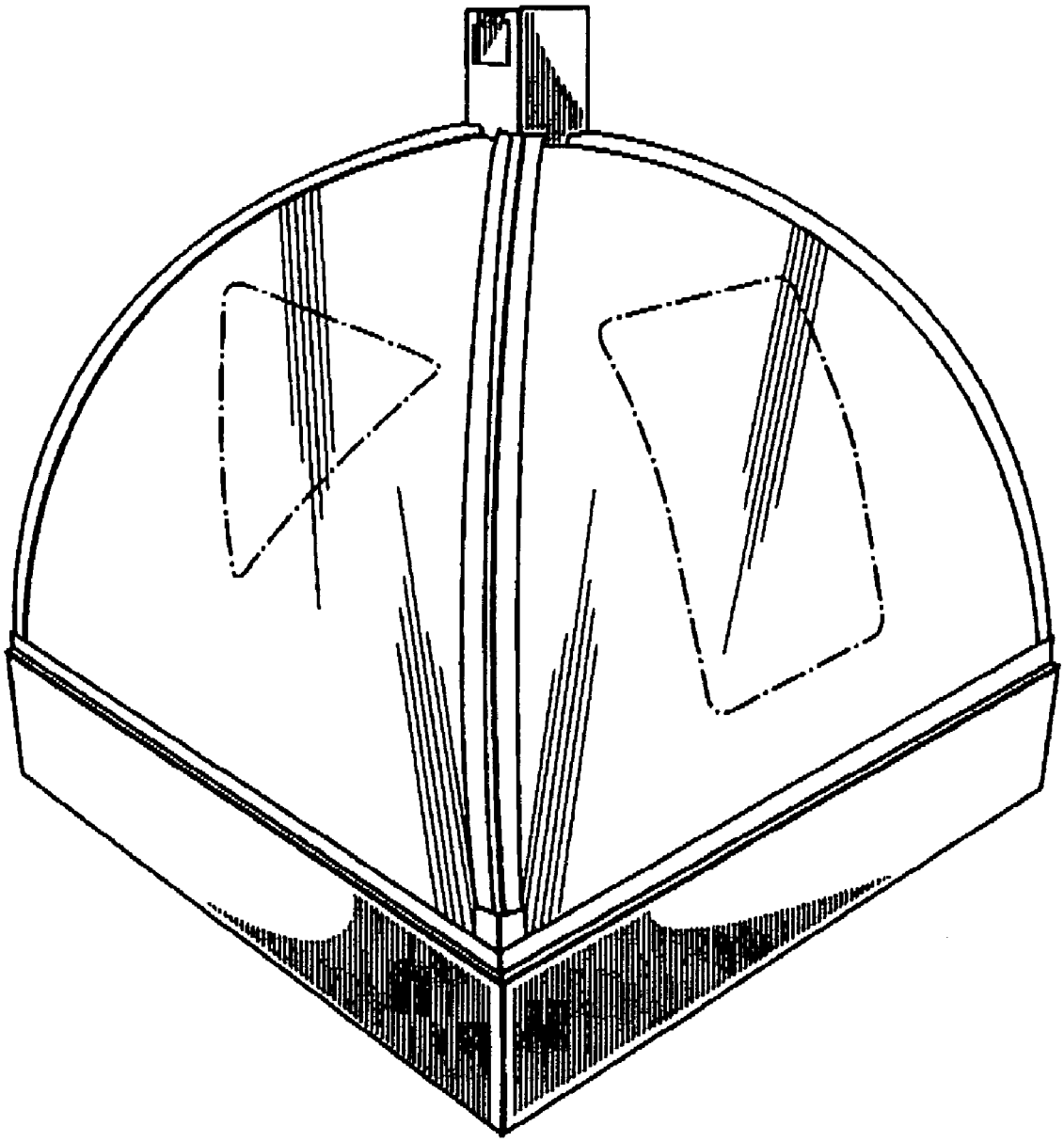
FIG. 1 shows a finished luminaire according to one embodiment.
Figure 2:
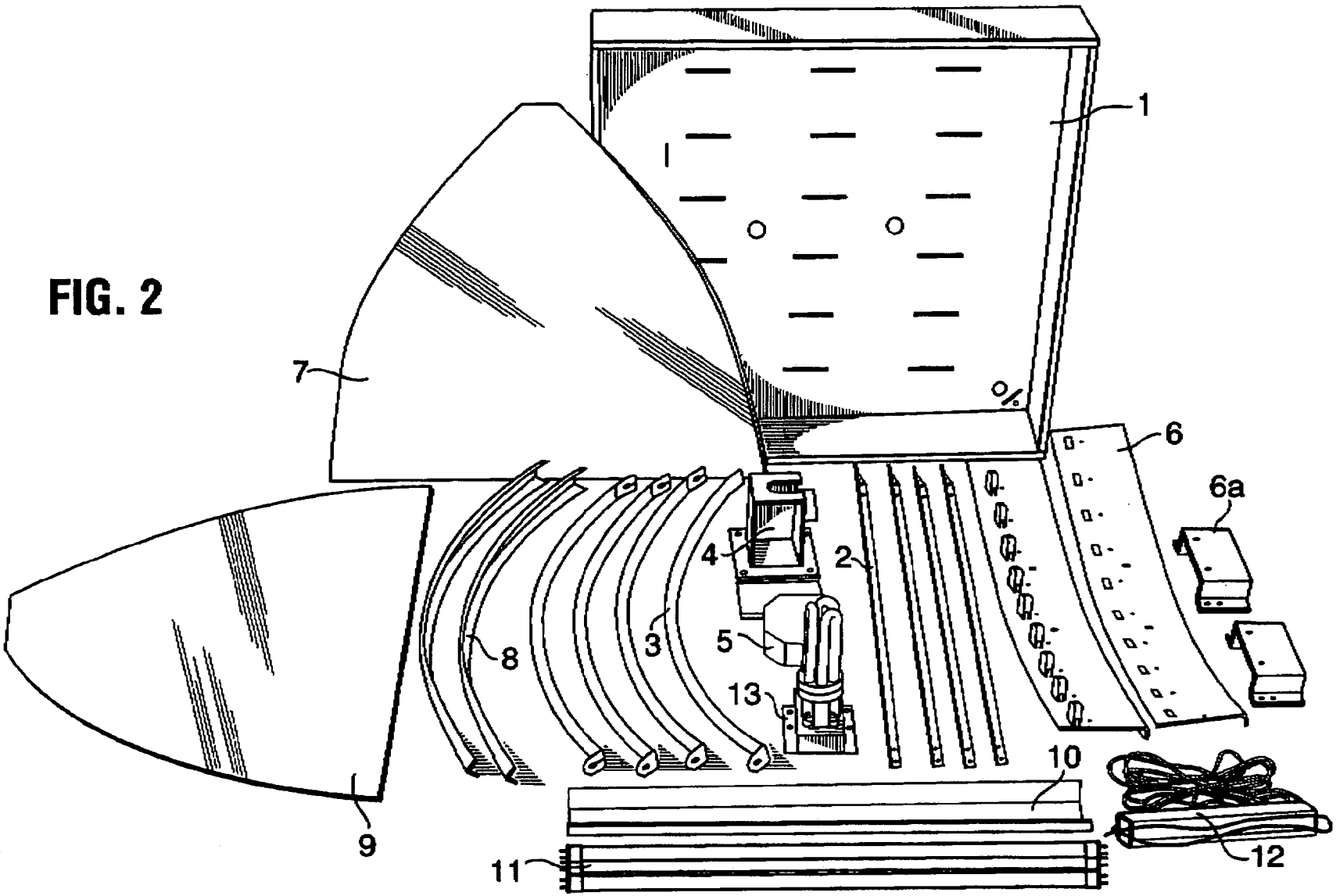
FIG. 2 shows the luminaire of FIG. 1 in exploded view to show the component parts.

Referring to FIG. 1 there is shown a completed luminaire and the component parts thereof are shown in FIG. 2 to comprise box 1, four perimeter angle rails 2, four support tubes 3, top wiring and suspension box 4, wiring connection box 5, socket support 6, socket support bracket 6*a*, two opaque shielding panels 7, two shielding retainers 8, opaque sign panels 9, a number of reflectors 10, a number of lamps 11, and a ballast 12.

Figure 3:
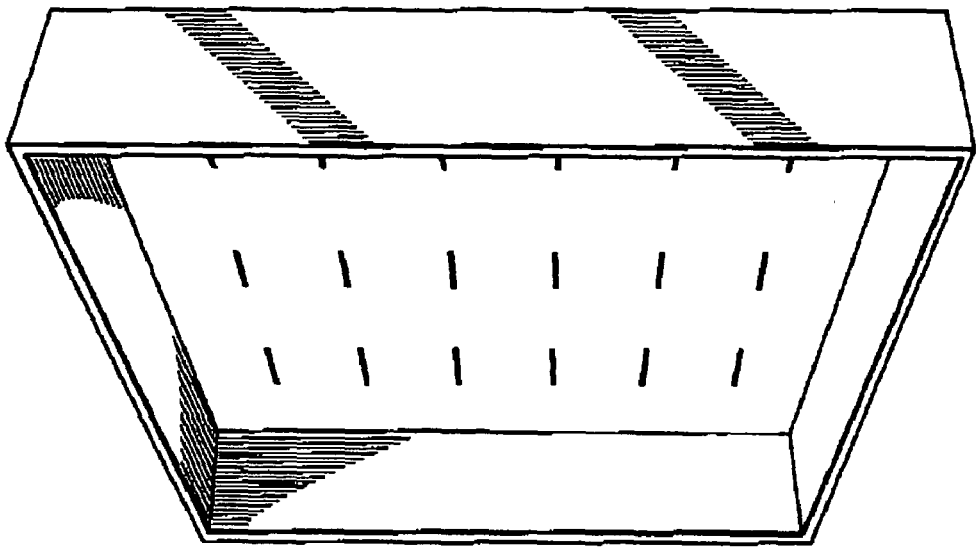
FIGS. 3 through 29 show the construction of the finished luminaire of FIG. 1 by showing all the individual components and the step by step sequence in which they fit together to provide the various aspects of the embodiment.

Referring to the other figures, FIG. 3 shows the box 1 with dimensions 24"×24"×4 ½", but it may have different dimensions as required.

Figure 4:
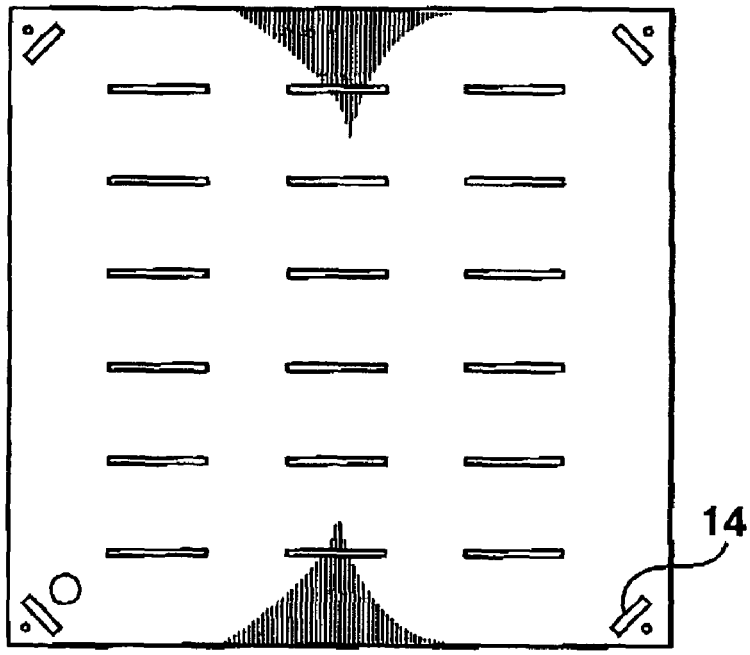

FIG. 4 shows the back side of the box 1 with corner slots 14.

Figure 5:
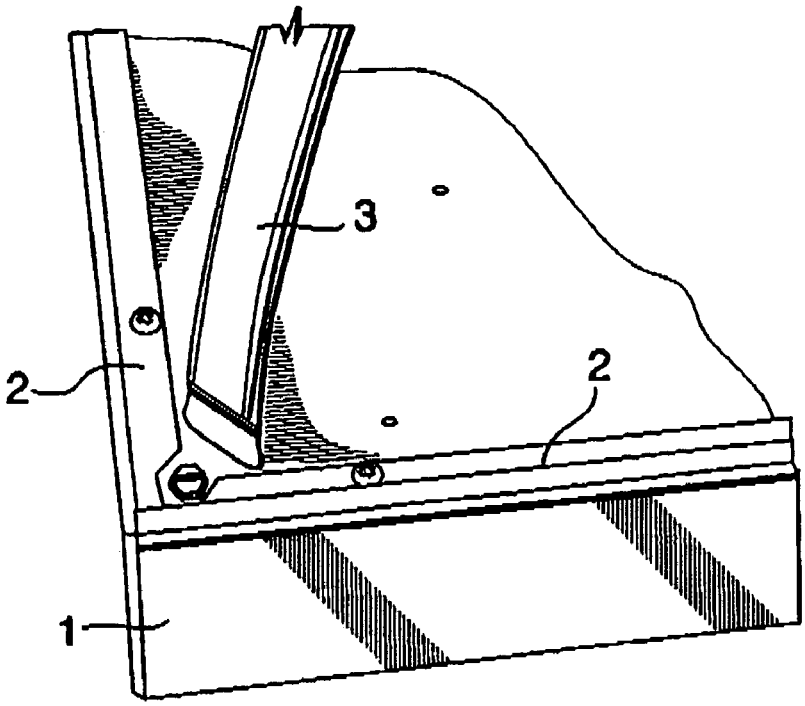
Figure 6:
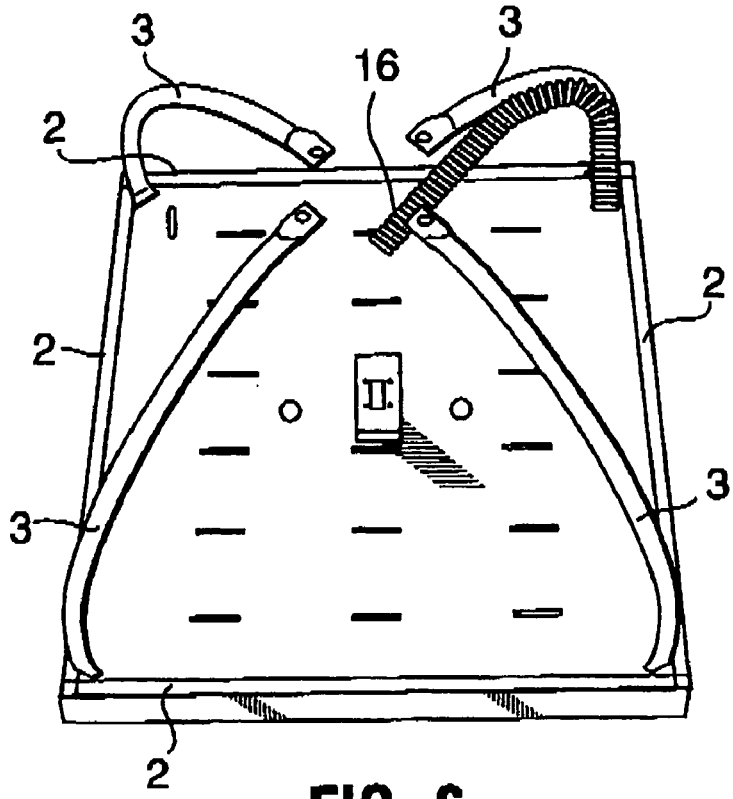

During construction of the luminaire, perimeter angle rails 2 and support tubes 3 are attached to the box 1 (as shown in FIGS. 5 and 6). A wiring conduit 16 is added (as shown in FIG. 6).

Figure 7:
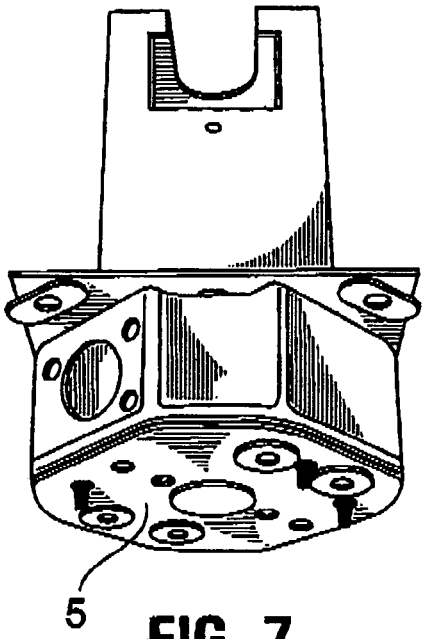
Figure 8:
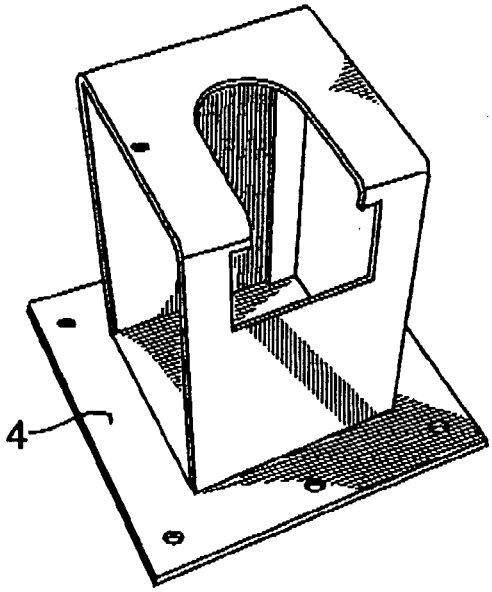
Figure 9:
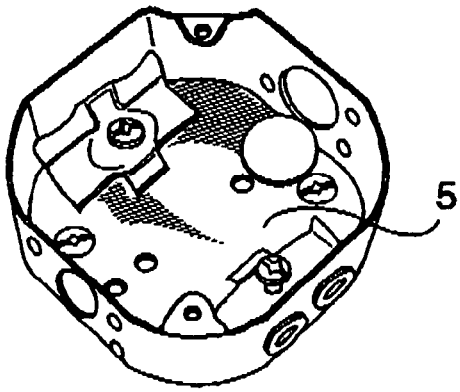

FIG. 7 shows the top wiring and suspension box 4 and wiring connection box 5 assembled together. FIG. 8 shows the top wiring and suspension box 4 alone whist FIG. 9 shows the wiring connection box 5 alone.

Figure 10:
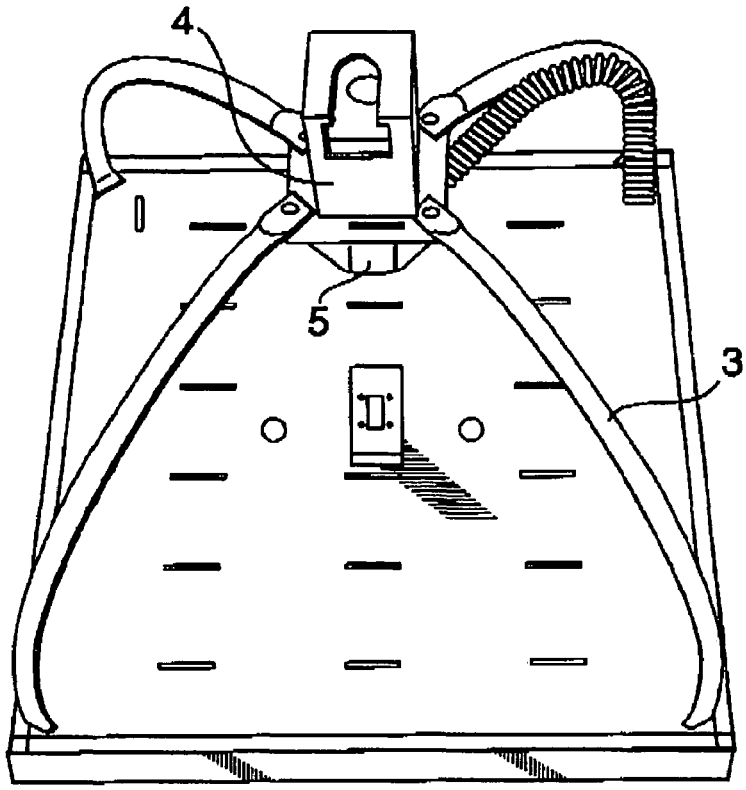

Referring to FIG. 10 it will be seen that the top wiring and suspension box 4 and wiring connection box 5 are assembled with the four support tubes 3.

Figure 11:
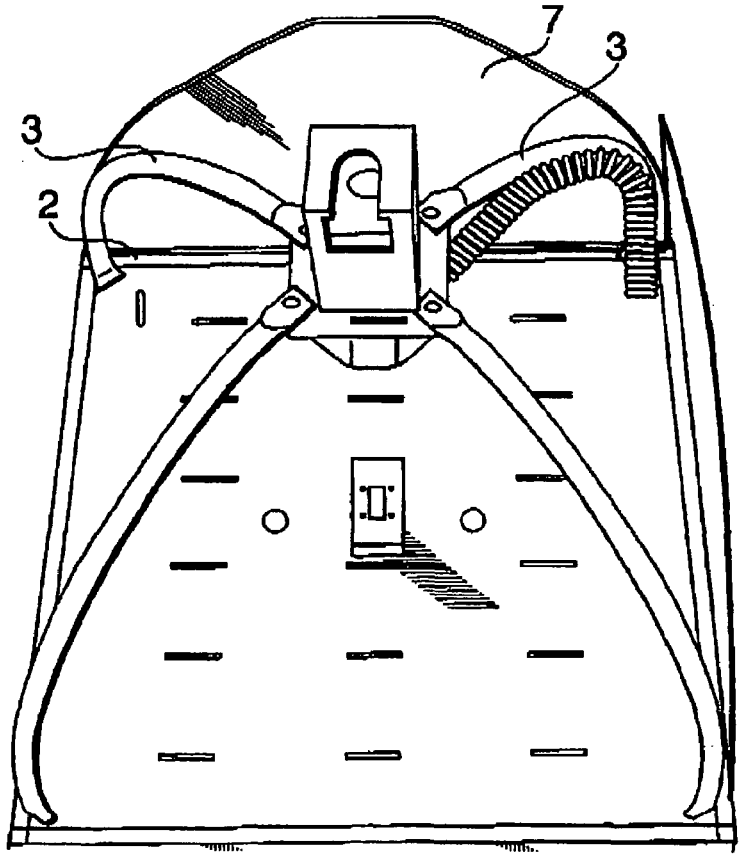

Two opaque shielding panels 7 are then placed in the perimeter angle rails 2 and bent such that they touch the support tubes 3 as shown in FIG. 11.

Figure 12:
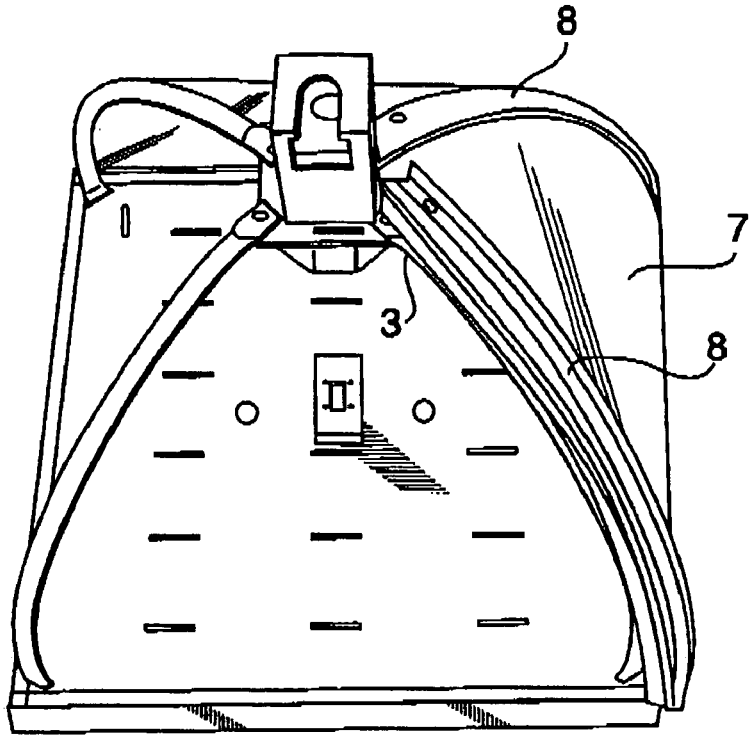

Shield retainers 8 are attached to retain the opaque shielding panels 7 as shown in FIG. 12.

Figure 13:
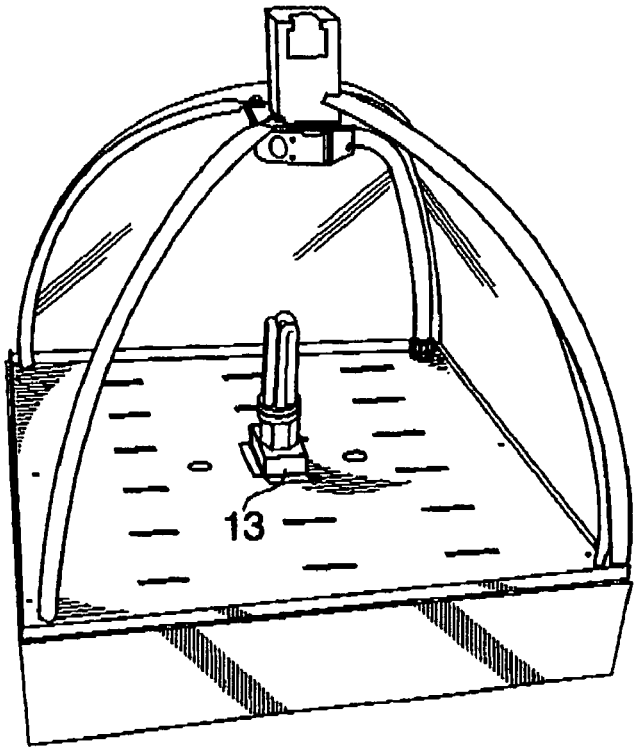

A lamp 13 is attached to illuminate the luminaire as shown in FIG. 13.

Figure 14:
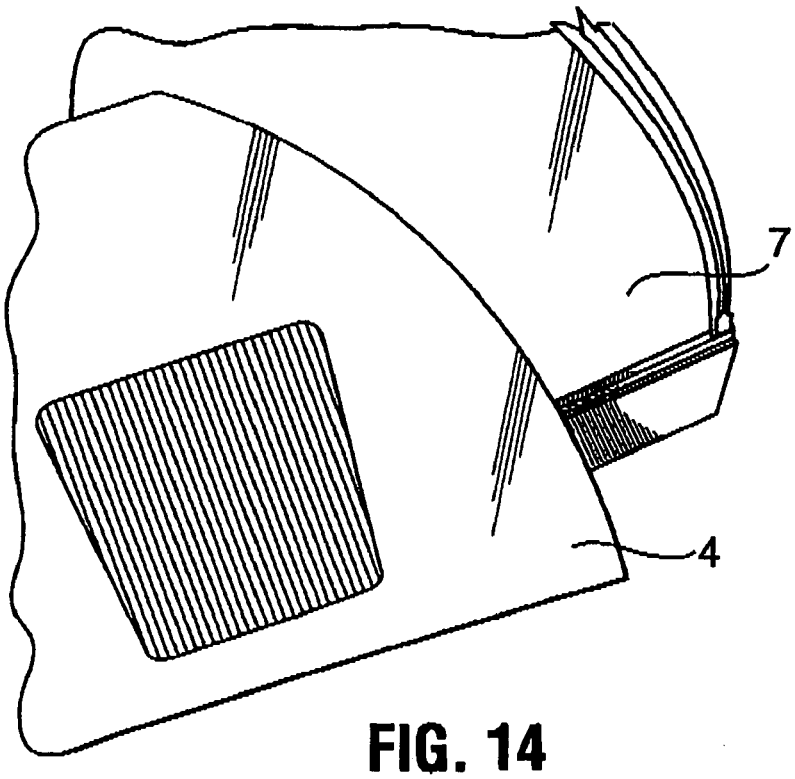
Figure 15:
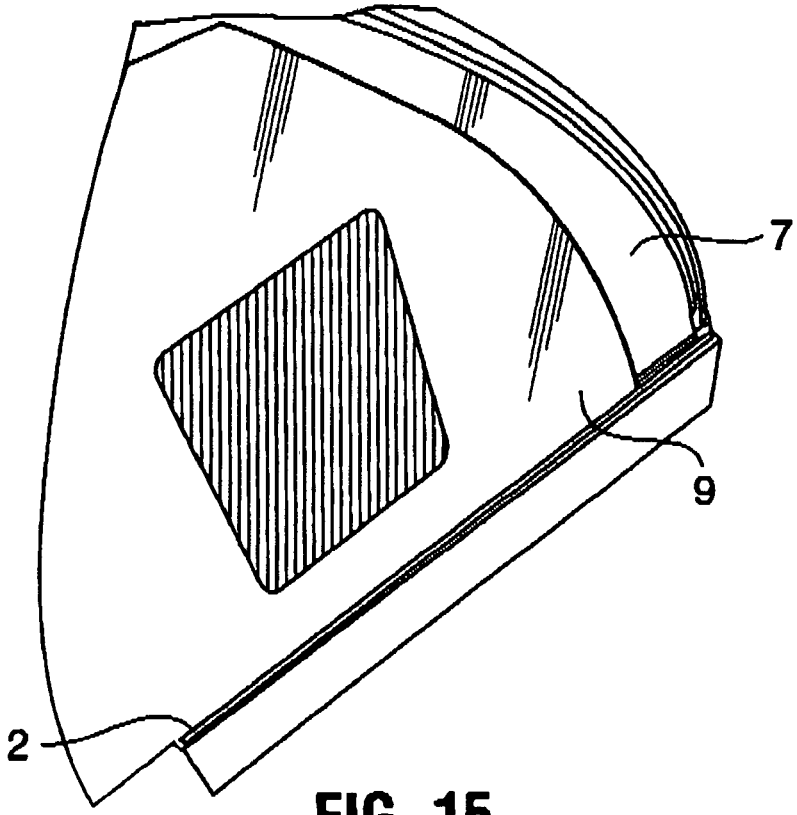
Figure 16:
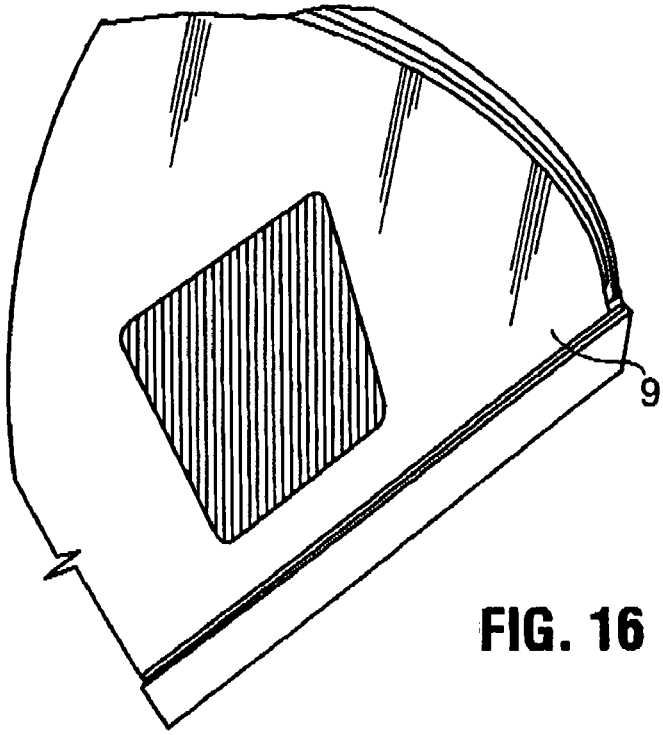

A typical removable opaque sign panel 9 is shown in FIG. 14 and this is inserted on top of the permanent opaque shielding panel 7. FIG. 15 shows how the insertion takes place against perimeter rail 2 which holds it in position and FIG. 16 shows an opaque sign panels 9 fully inserted.

Figure 17:
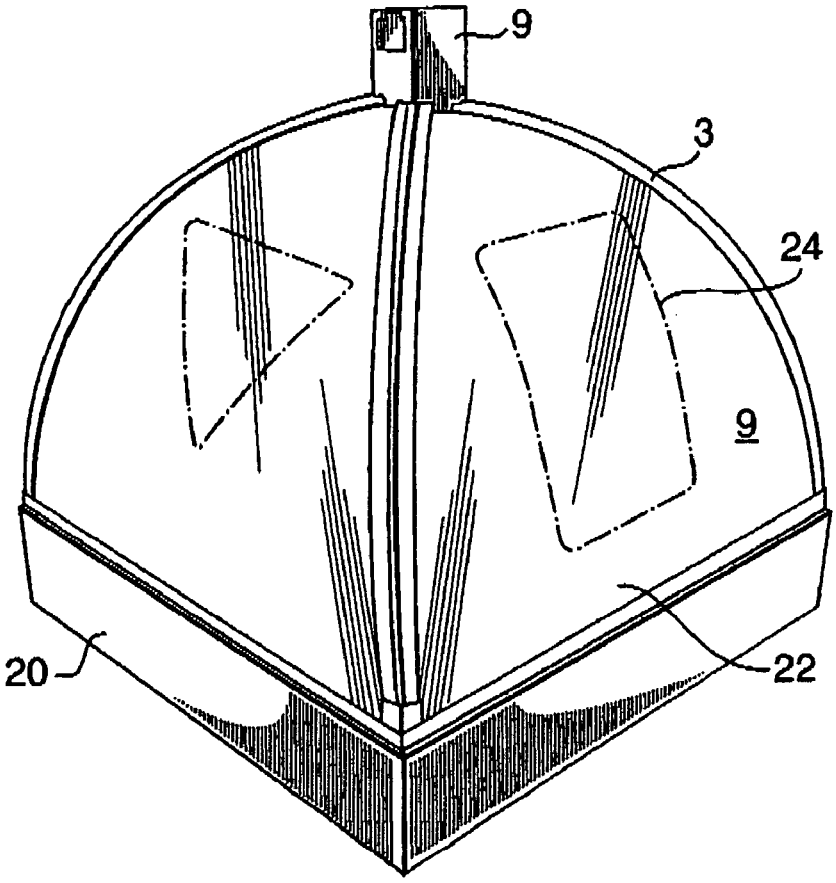
Figure 18:
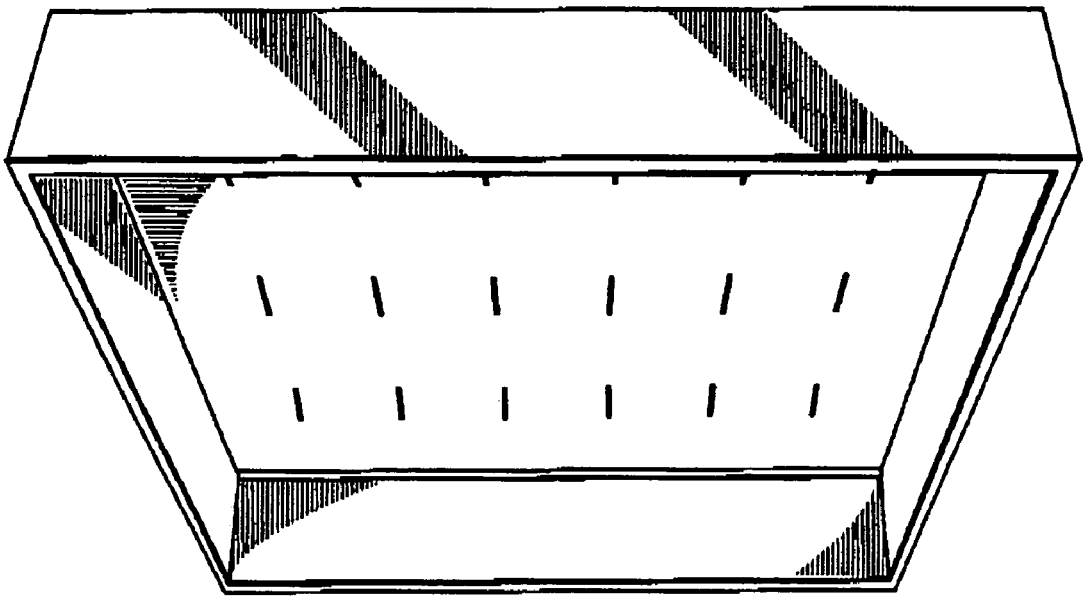
Figure 19:
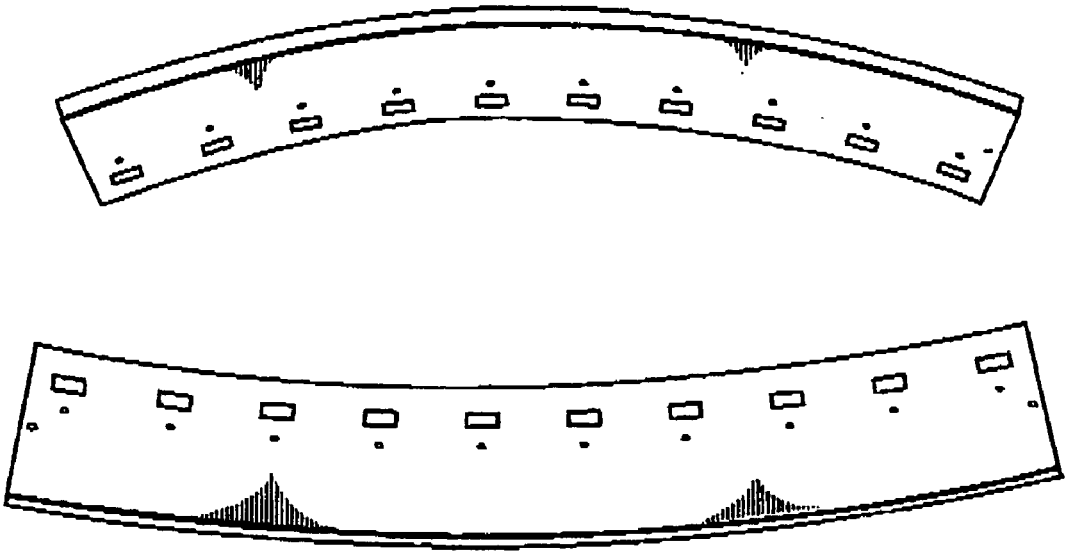
Figure 29:
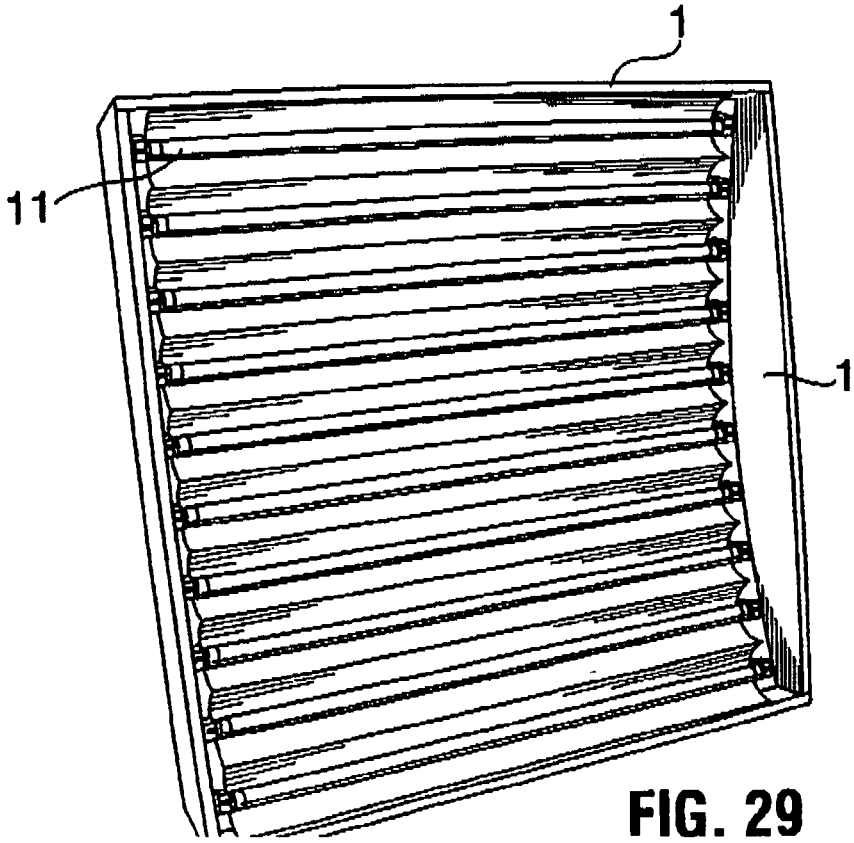

In FIG. 17 the completed luminaire is illustrated and comprises a lower portion 20, including the box 1 with its ten lamps 11 installed as shown in FIG. 29. The upper portion 22 comprises the support tubes 3, suspension box 4, panels 7 and 9, the latter having an advertising sign 24 thereon. The upper portion 22 includes lamp 13 as seen in FIG. 13. In use the lamps 11 illuminate the space beneath whilst lamp 13 illuminates the top portion including advertising sign 24.

Figure 20:
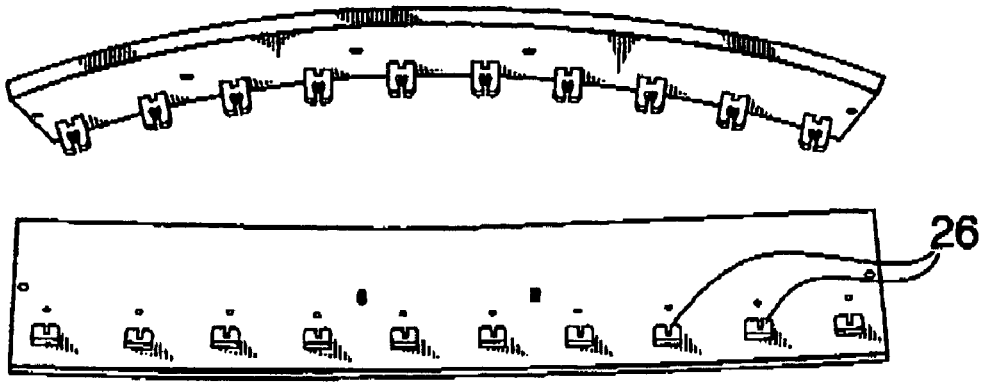
Figure 21:
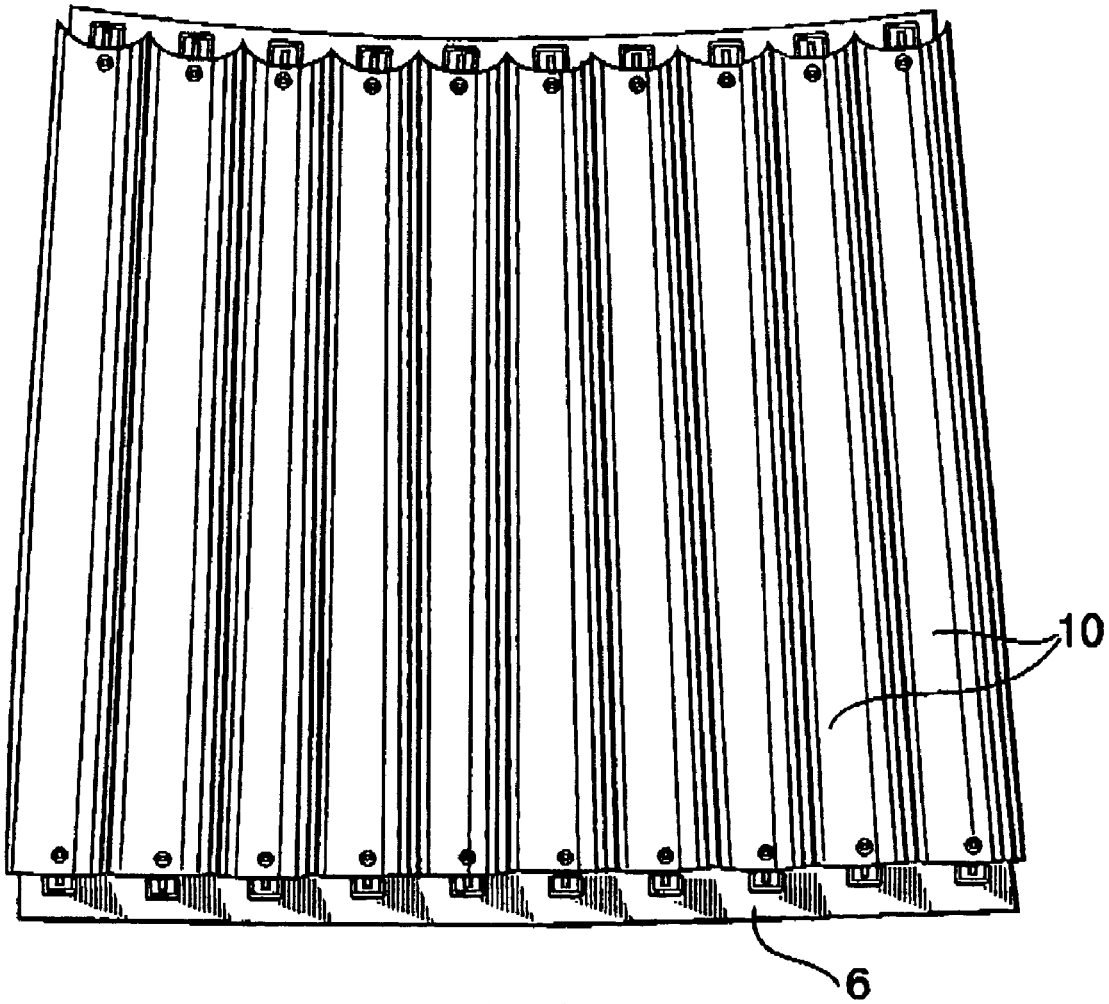
Figure 22:
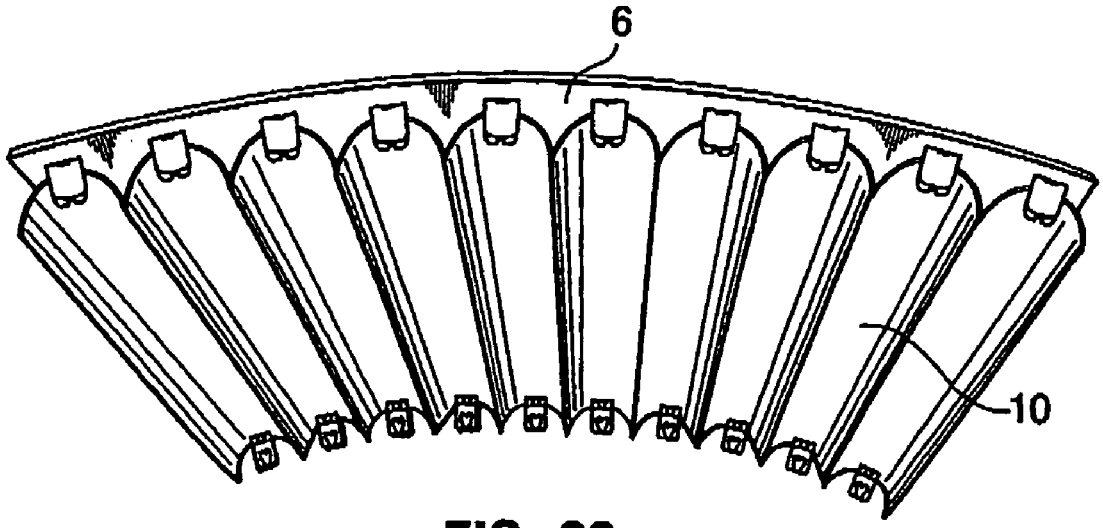

In FIG. 20, the socket supports 6 have been fitted with sockets 26 to receive the reflectors 10 (as shown in FIGS. 21 and 22).

Figure 23:
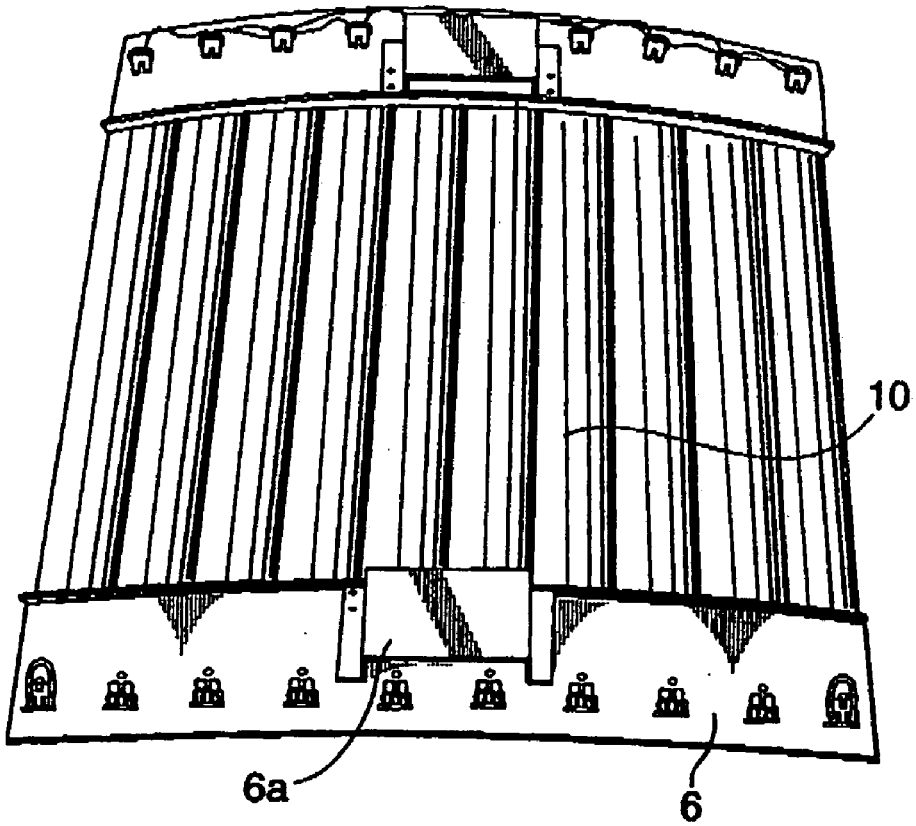

FIG. 23 shows the back side of FIG. 21 with socket support bracket 6*a* added.

Figure 24:
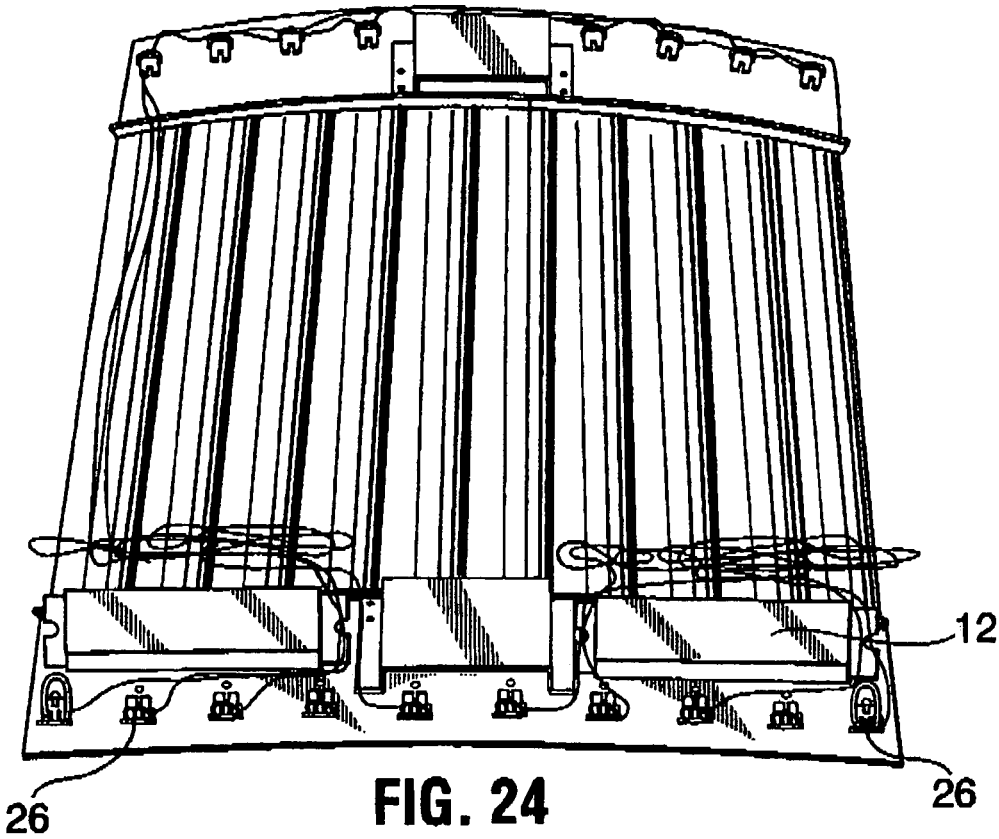

The modular wiring arrangement is shown in FIG. 24 with the socket supports 6, reflectors 10, ballast 12, plus sockets 26 and all wiring on one assembly for quick insertion in the box 1.

Figure 25:
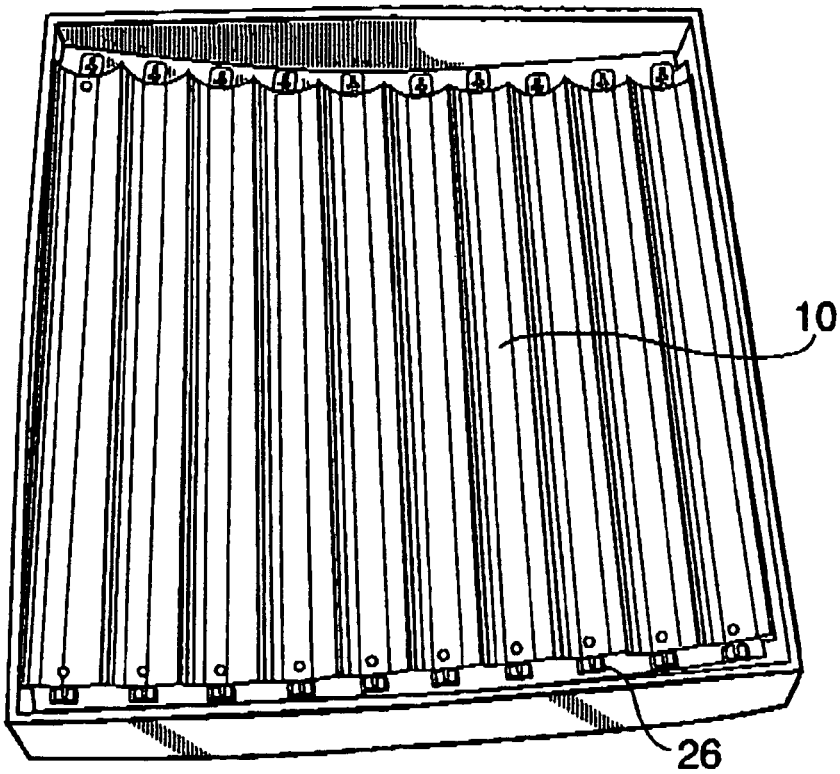

FIG. 25 shows the complete assembly of socket support modular assembly in the box 1.

Figure 26:
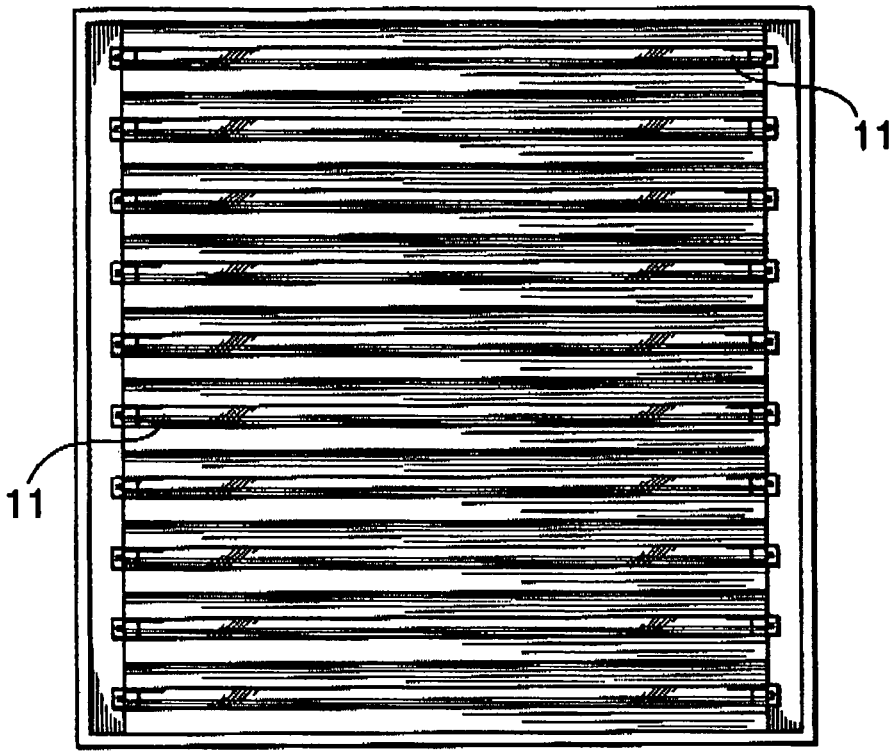

FIG. 26 shows the ten lamps 11 installed.

Figure 27:
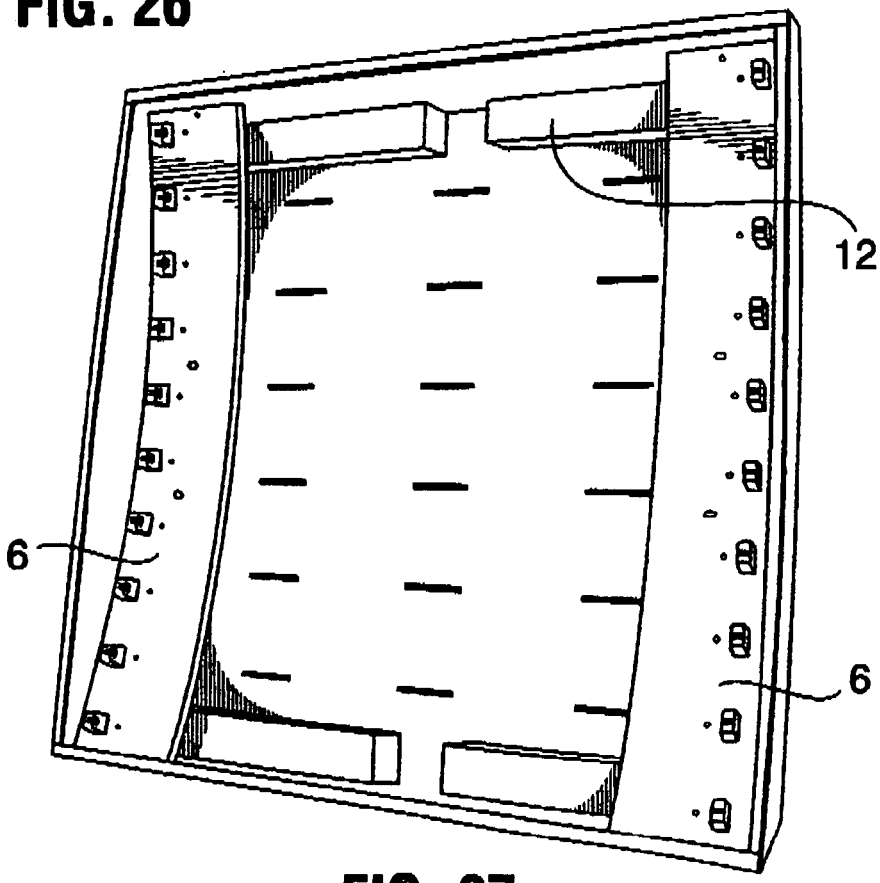

In FIG. 27, there is shown an alternate socket 6 installation with ballast 12 installed in box 1.

Figure 28:
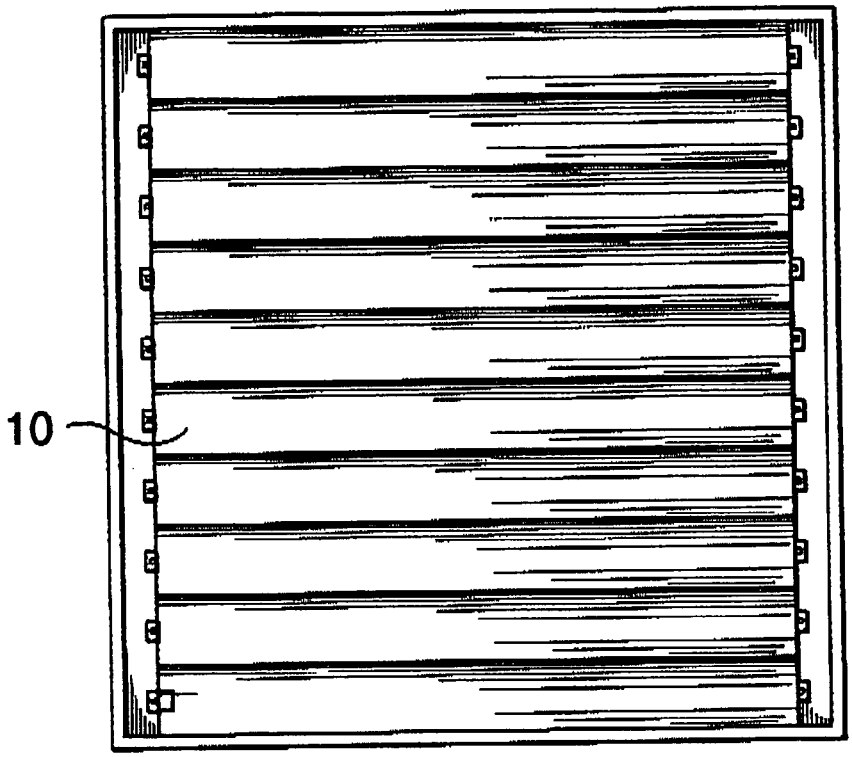

FIG. 28 shows the complete lower compartment with reflectors and socket support, but without the lamps, while FIG. 29 shows the lamps 11 installed.

The illustrated embodiments in the figures are for an improved fluorescent luminaire with a novel socket support plate design to make a 2 ft wide fluorescent luminaire accommodate up to 10 high output modern T-5 fluorescent lamps rather than 4 or 6 lamps of the present practice. The box 1 is shown as of square plan view but it will be understood that it may be rectangular, elliphiral, or circular. If circular, the support tubes 3 may not be required and the upper portion will effectively comprise a single side panel.

This increased lamp density per luminaire, reduces the number of luminaries per installation. It also provides installation flexibility in individual rather than in continuous linear row mounting and the high light density makes it possible to use fluorescent fixtures mounted at high elevations where ceiling heights may reach 30 or 35 ft which was not practical with conventional luminaries.

A modular type luminaire is illustrated where all the electrical components such as ballasts, lamps and sockets can all be pre-assembled as a modular unit that can, quickly and easily, be inserted or removed from the luminaire. This modularity appreciably reduces the cost of the fixture assembly and allows the use of many different ballast lamp combinations in the same housing in a quick and easy manner.

There is illustrated an improved fluorescent luminaire that provides both main lighting of space and at the same time provides the sign or advertising lighting from the same luminaire rather than from two independent luminaries as in the present practice by incorporating a specially designed top with 4 luminous sides on which logos, signs or advertising material posters can be placed and exchanged easily without affecting any of the luminaire functions or its safety features.

The general space lighting function of this improved fixture is provided through the lower section of the fixture while the commercial messages or directional signs are provided through the top section, thus combining two functions in one luminaire with big savings in installation and in operation cost.

Furthermore, the utility of a fluorescent luminaries commonly purchased for the sole purpose of lighting space in commercial or industrial applications is increased since it is converted into a revenue generating luminaire through the capability of the improved design to carry messages and product advertisements and the possibility of selling same for the same luminaire.

A further advantage of the described embodiment is that the signs displayed by this improved fixture are not restricted in viewing to the immediate vicinity of the luminaire but are visible from across a wide floor area due to the high installation location of the luminaire.

It will also be appreciated that the upper compartment can be alternately used to provide services such as emergency or night lighting without affecting the main lighting provided by the luminaire while maintaining its advertising capability.

There is described a flexible suspended mounting capability that allows multi-circuit entry connection in various forms and that provides an appealing visual appearance while providing increased installation security of a suspended fluorescent fixture due to the special design of its mounting attachment.

While the invention has been described with reference to specific embodiments, modifications and variations of the invention may be constructed without departing from the scope of the invention, which is defined in the following claims.

We claim:

1. A luminaire comprising:

a) a lower portion of square cross-section with four sides and supporting a plurality of fluorescent lamps to illuminate the space therebeneath, b) an upwardly projecting rail portion extending along each side of said lower portion, c) a dome-shape upper portion above said lower portion and having a curved support tube upstanding at each corner of said lower portion to meet at a peak and form a support structure, d) opaque side panels extending between each pair of support tubes and supported thereon to form said dome-shaped upper portion, e) a retainer on each support tube to hold said side panels, f) at least one removable side panel for supporting an advertising sign, each removable side panel being mounted over one of said opaque side panels, g) said upper portion having at least one lamp to illuminate each advertising sign thereon, and h) a top wiring, suspension box at said peak.

* * * * *